US006379272B1

(12) United States Patent
Gorgo et al.

(10) Patent No.: US 6,379,272 B1
(45) Date of Patent: Apr. 30, 2002

(54) BACKSTOP AND SPORTS BALL RETURN ASSEMBLY

(76) Inventors: Anthony Gorgo; Emma Gorgo, both of 341 Catawba Ave., Newfield, NJ (US) 08344

( * ) Notice: Subject to any disclaimer, the term of this patent is extended or adjusted under 35 U.S.C. 154(b) by 0 days.

(21) Appl. No.: 09/548,252

(22) Filed: Apr. 12, 2000

(51) Int. Cl.[7] ..... A63B 69/00

(52) U.S. Cl. ..... 473/421; 473/431; 273/407

(58) Field of Search ..... 273/410, 400, 273/375, 348, 394, 127 C; 473/197, 416, 421, 422, 431, 432, 435, 436, 451, 454, 476, 477, FOR 103, FOR 104; 135/88, 132; D21/305

(56) References Cited

U.S. PATENT DOCUMENTS

| | | | | | |
|---|---|---|---|---|---|
| 849,941 | A | * | 4/1907 | Titus | 473/421 |
| 2,923,547 | A | | 2/1960 | Heeremans | |
| 3,194,556 | A | | 7/1965 | Vinson | |
| 3,408,071 | A | * | 10/1968 | Lundy | 473/421 |
| 3,411,788 | A | * | 11/1968 | Blanding | 473/421 |
| 4,074,905 | A | | 2/1978 | High | |
| 4,286,786 | A | * | 9/1981 | Papadopoulos | 473/432 |
| 5,042,820 | A | * | 8/1991 | Ford | 473/436 |
| 5,133,548 | A | | 7/1992 | Bedord et al. | |
| 5,141,226 | A | | 8/1992 | Cavanagh | |
| 5,205,564 | A | | 4/1993 | Lamberti et al. | |
| 5,271,616 | A | | 12/1993 | Grimaldi | |
| 5,431,411 | A | | 7/1995 | Padilla | |
| 5,485,994 | A | | 1/1996 | Underwood et al. | |
| D375,528 | S | | 11/1996 | Raines et al. | |
| 5,672,125 | A | * | 9/1997 | Ross | 473/421 |
| 5,746,670 | A | * | 5/1998 | Brady | 473/451 |

* cited by examiner

*Primary Examiner*—Paul T. Sewell
*Assistant Examiner*—Mitra Aryanpour

(57) ABSTRACT

A backstop and sports ball return assembly for facilitating building a users skill and accuracy by providing the return of a selectable sports ball to the user includes a base assembly. The base assembly includes a collection well and a chute extending from the collection well. The collection well includes an inclined bottom surface and at least one angled wall such that the collection well directs a sports ball towards the chute when the sports ball enters the collection well. A pair of side wall members are coupled to the base. The side wall members extend upwardly from opposite sides of the base assembly. A rear assembly is coupled to the base assembly, the rear assembly extending between the side wall members. A top assembly is coupled to the side wall members and the rear assembly, the top assembly extending generally between the side wall members.

10 Claims, 4 Drawing Sheets

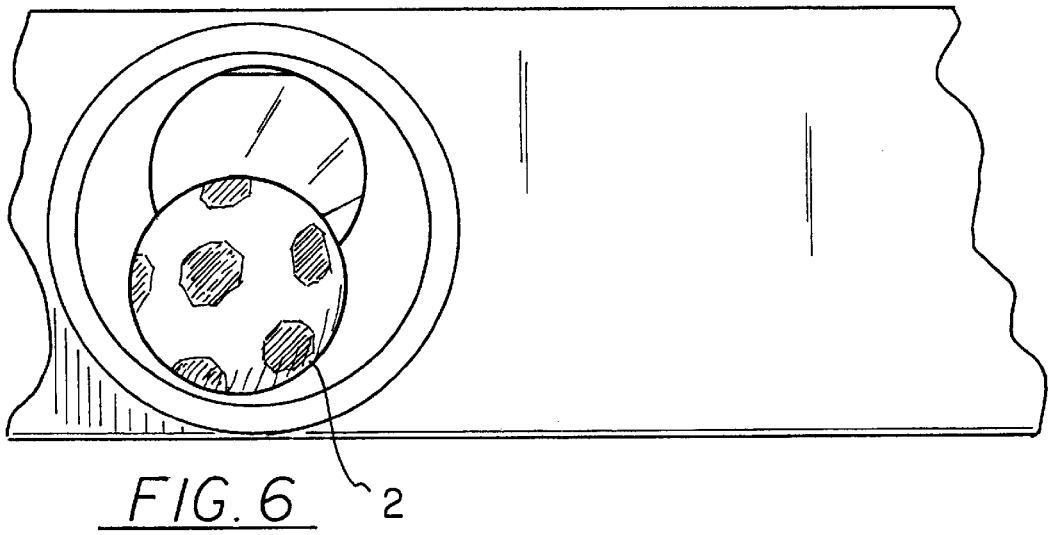
FIG. 6
FIG. 7
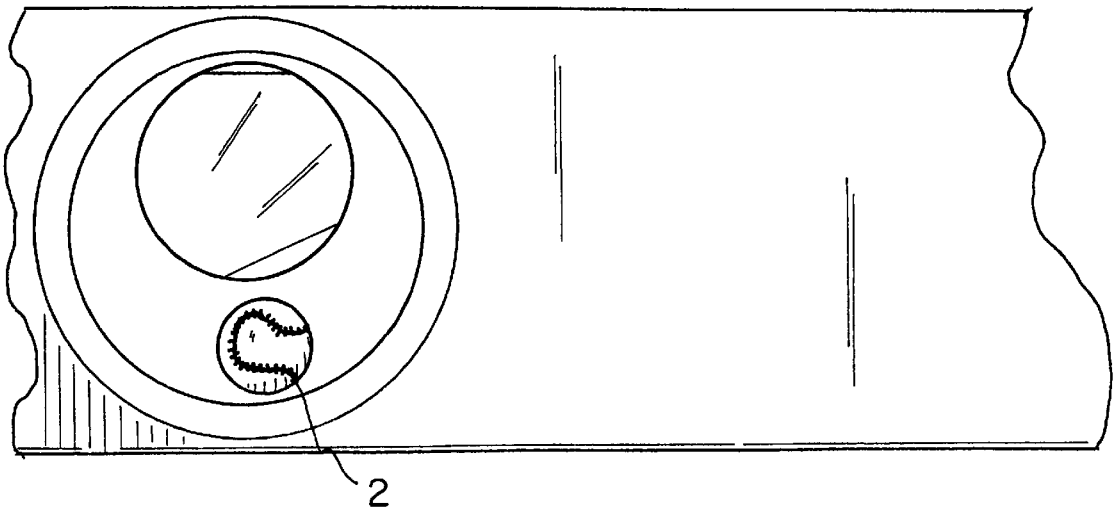

BACKSTOP AND SPORTS BALL RETURN ASSEMBLY

BACKGROUND OF THE INVENTION

1. Field of the Invention

The present invention relates to ball return assemblies and more particularly pertains to a new backstop and sports ball return assembly for building a users skill and accuracy by providing a portable means of returning a variety of sports balls to a user.

2. Description of the Prior Art

The use of ball return assemblies is known in the prior art. More specifically, ball return assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,485,994; U.S. Pat. No. DES. 375,528; U.S. Pat. No. 5,205,564; U.S. Pat. No. 2,923,547; U.S. Pat. No. 5,431,411; and U.S. Pat. No. 5,133,548.

While these devices fulfill their respective, particular objectives and requirements, the aforementioned patents do not disclose a new backstop and sports ball return assembly. The inventive device includes a base assembly that includes a collection well portion and a chute extending from the collection well. The collection well includes an inclined bottom surface and at least one angled wall whereby the collection well is designed for directing a sports ball towards the chute when the sports ball enters the collection well. A pair of side wall members are coupled to the base. The side wall members extend upwardly from opposite sides of the base assembly. A rear assembly is coupled to the base assembly, the rear assembly extending between the side wall members. A top assembly is coupled to the side wall members and the rear assembly, the top assembly extending generally between the side wall members.

In these respects, the backstop and sports ball return assembly according to the present invention substantially departs from the conventional concepts and designs of the prior art, and in so doing provides an apparatus primarily developed for the purpose of building a users skill and accuracy by providing a light weight and portable means of returning a variety of sports balls to a user.

SUMMARY OF THE INVENTION

In view of the foregoing disadvantages inherent in the known types of ball return assemblies now present in the prior art, the present invention provides a new backstop and sports ball return assembly construction wherein the same can be utilized for building a users skill and accuracy by providing a light weight and portable means of returning a variety of sports balls to a user.

The general purpose of the present invention, which will be described subsequently in greater detail, is to provide a new backstop and sports ball return assembly apparatus and method which has many of the advantages of the ball return assemblies mentioned heretofore and many novel features that result in a new backstop and sports ball return assembly which is not anticipated, rendered obvious, suggested, or even implied by any of the prior art ball return assemblies, either alone or in any combination thereof.

To attain this, the present invention generally includes a base assembly, the base assembly includes a collection well portion and a chute extending from the collection well. The collection well includes an inclined bottom surface and at least one angled wall whereby the collection well is designed for directing a sports ball towards the chute when the sports ball enters the collection well. A pair of side wall members coupled to the base. The side wall members extending upwardly from opposite sides of the base assembly. A rear assembly coupled to the base assembly, the rear assembly extending between the side wall members. A top assembly coupled to the side wall members and the rear assembly, the top assembly extending generally between the side wall members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new backstop and sports ball return assembly apparatus and method which has many of the advantages of the ball return assemblies mentioned heretofore and many novel features that result in a new backstop and sports ball return assembly which is not anticipated, rendered obvious, suggested, or even implied by any of the prior art ball return assemblies, either alone or in any combination thereof.

It is another object of the present invention to provide a new backstop and sports ball return assembly which may be easily and efficiently manufactured and marketed.

It is a further object of the present invention to provide a new backstop and sports ball return assembly which is of a durable and reliable construction.

An even further object of the present invention is to provide a new backstop and sports ball return assembly which is susceptible of a low cost of manufacture with regard to both materials and labor, and which accordingly is then susceptible of low prices of sale to the consuming public, thereby making such backstop and sports ball return assembly economically available to the buying public.

Still yet another object of the present invention is to provide a new backstop and sports ball return assembly which provides in the apparatuses and methods of the prior art some of the advantages thereof, while simultaneously overcoming some of the disadvantages normally associated therewith.

Still another object of the present invention is to provide a new backstop and sports ball return assembly for building a users skill and accuracy by providing a light weight and portable means of returning a variety of sports balls to a user.

Yet another object of the present invention is to provide a new backstop and sports ball return assembly that includes a base assembly having a collection well portion and a chute extending from the collection well. The collection well includes an inclined bottom surface and at least one angled wall whereby the collection well is designed for directing a sports ball towards the chute when the sports ball enters the collection well. A pair of side wall members are coupled to the base. The side wall members extend upwardly from opposite sides of the base assembly. A rear assembly is coupled to the base assembly, the rear assembly extending between the side wall members. A top assembly is coupled to the side wall members and the rear assembly, the top assembly extending generally between the side wall members.

Still yet another object of the present invention is to provide a new backstop and sports ball return assembly that is easily adjusted to work for many different types of sports balls.

Even still another object of the present invention is to provide a new backstop and sports ball return assembly that is relatively lightweight and portable allowing a user to easily transport and store the unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a front view of the chute of the present invention.

FIG. 7 is a front view of the chute of the present invention.

DESCRIPTION OF THE PREFERRED EMBODIMENT

Figure 1:
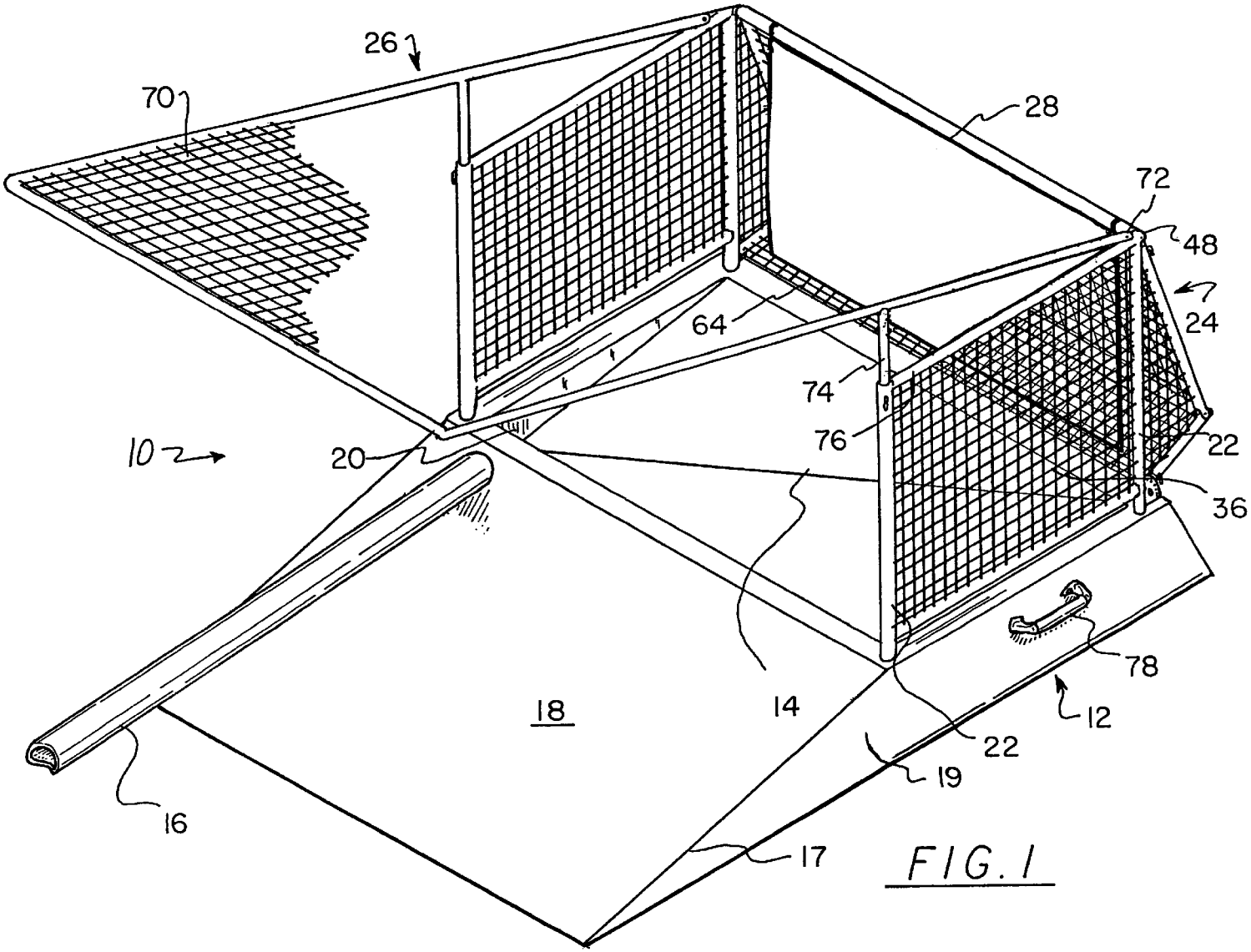
FIG. 1 is a perspective view of a new backstop and sports ball return assembly according to the present invention.
Figure 2:
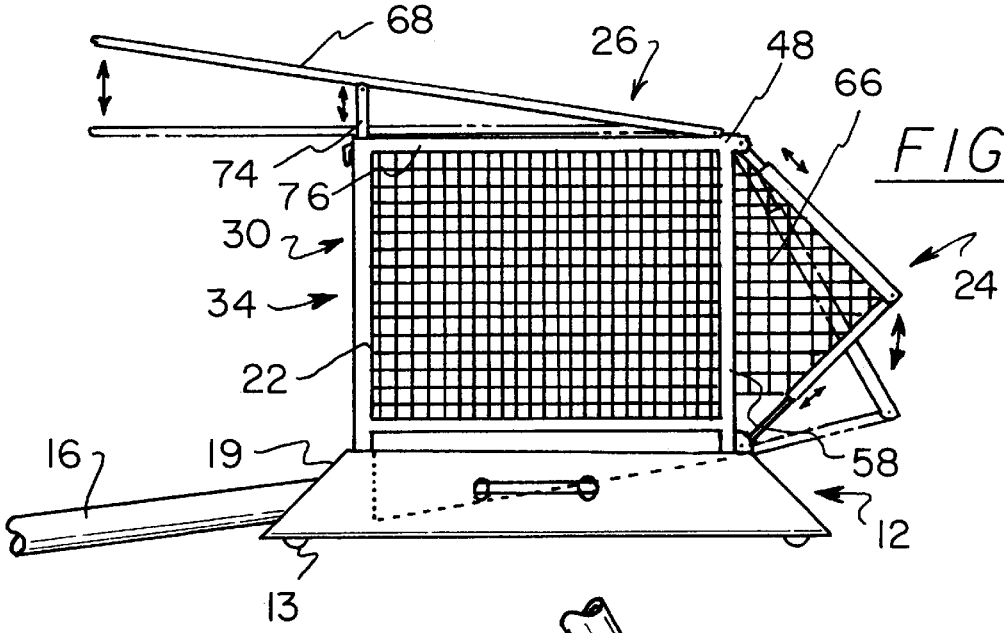
FIG. 2 is a side view of the present invention.
Figure 3:
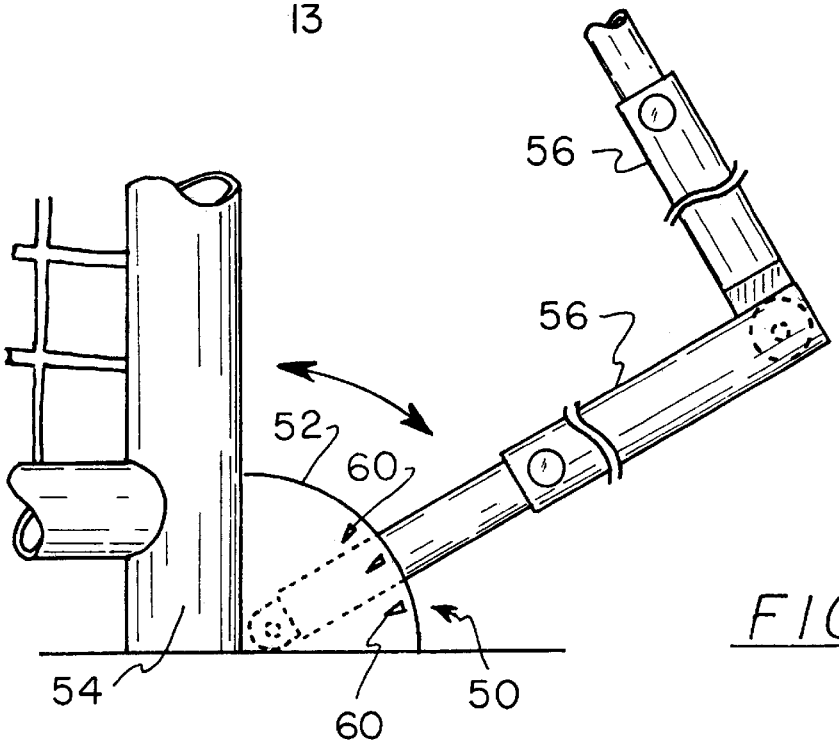
FIG. 3 is a side view of the rear assembly connection of the present invention.
Figure 4:
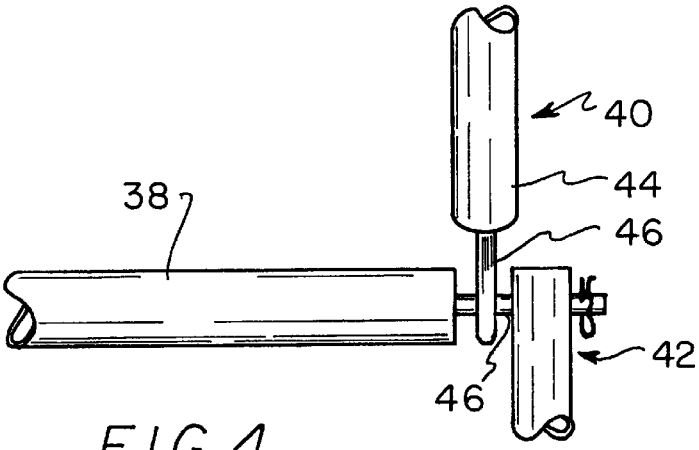
FIG. 4 is a front view of the center bar and top bar assembly of the present invention.
Figure 5:
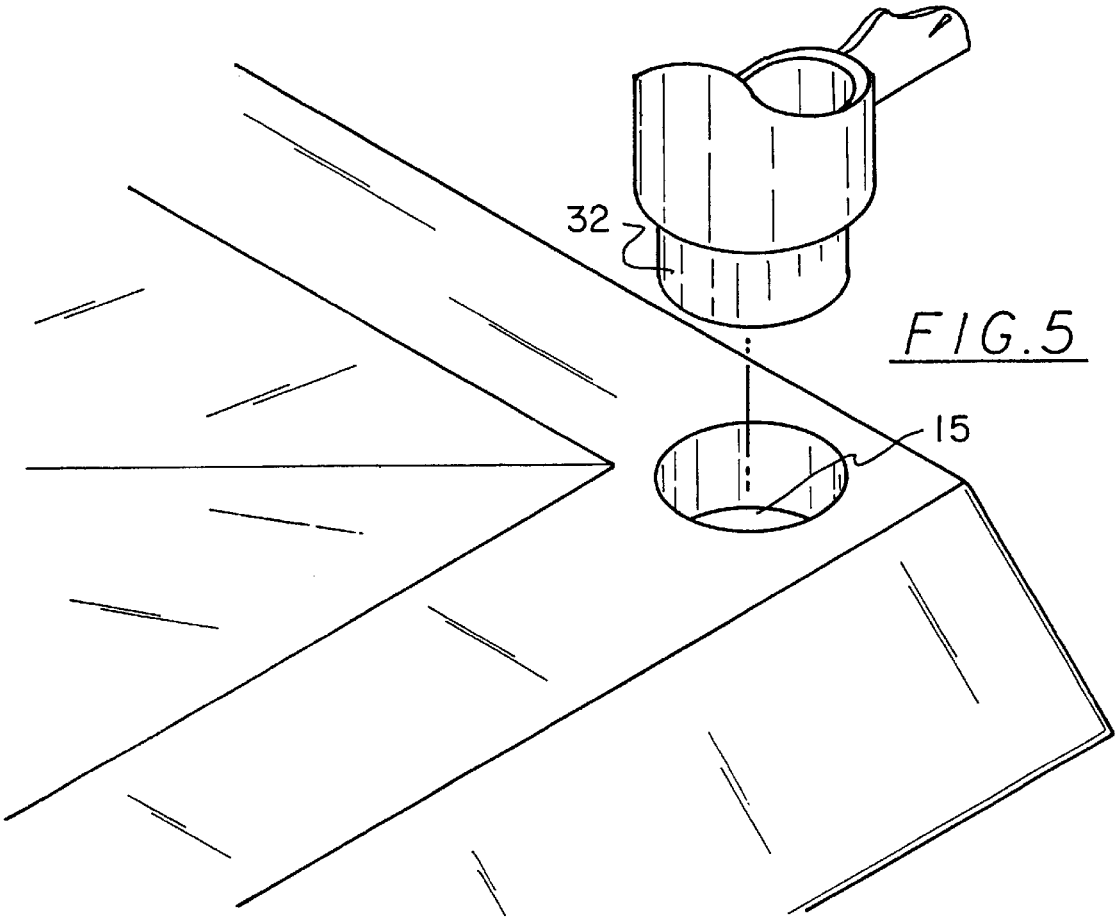
FIG. 5 is a perspective view of the present invention.

With reference now to the drawings, and in particular to FIGS. 1 through 7 thereof, a new backstop and sports ball return assembly embodying the principles and concepts of the present invention and generally designated by the reference numeral 10 will be described.

As best illustrated in FIGS. 1 through 7, the backstop and sports ball return assembly 10 generally comprises a base assembly 12, the base assembly 12 includes a collection well portion 14 and a chute 16 extending from the collection well 14. The collection well 14 includes an inclined bottom surface 18 and at least one angled wall 20 whereby the collection well 14 is designed for directing a sports ball 2 towards the chute 16 when the sports ball 2 enters the collection well 14. A pair of side wall members 22 are coupled to the base 12, the side wall members 22 extending upwardly from opposite sides of the base assembly 12.

A rear assembly 24 is coupled to the base assembly 12, the rear assembly 24 extending between the side wall members 22. A top assembly 26 is coupled to the side wall members 22 and the rear assembly 24. The top assembly 26 extends generally between the side wall members 22. A sheet member 28 is coupled to the rear assembly 24 such that the sheet member 28 hangs freely in front of the rear assembly 24. Thus, the sheet member 28 is designed for deadening movement of the sports ball 2 when the sports ball 2 contacts the sheet member 28. The sheet member 28 further serves to direct the sports ball 2 into the collection well 14.

Each of the side wall members 22 includes a side wall frame 30 extending around an outer perimeter of the side walls 34. The side wall frame 30 includes a pair of protrusions 32 extending downwardly for engaging the base assembly 12. Each of the side walls 34 includes side wall netting 36 coupled to the side wall frame 30. The rear assembly 24 includes a substantially horizontal center bar 38, an upper portion 40 extending generally upward from the center bar 38, and a lower portion 42 extending generally downward from the center bar 38. The upper portion 40 is pivotal relative to the lower portion 42. A top bar 44 of the upper portion 40 is coupled between a pair of upper coupling members 46 extending outwardly from upper corners 48 of the side walls 34. A lower end 50 of the lower portion 42 is coupled between a pair of lower coupling members 52 extending outwardly from lower corners 54 of the side walls 34.

The side members 56 of the upper and lower portions are telescopic whereby the rear assembly 24 is adjustably positionable to vary the angles between the upper portion 40 and the lower portion 42 relative to a rearward edge 58 of the side wall members 22. The lower coupling members 52 include indicia 60 for facilitating aligning of the lower portion 42. Upper portion netting 62 is coupled to the upper portion 40 of the rear assembly 24. The lower portion netting 64 is coupled to the lower portion 42 of the rear assembly 24. Rear side netting 66 is coupled between outer edges of the upper portion 40, lower portion 42, and the side walls 34.

The top assembly 26 includes a top frame 68 and top netting 70 coupled to the top frame 68. The top frame 68 includes a rearward side 72 pivotally coupled to the side wall members 22 proximate the rear assembly 24. The top frame includes a pair of extension members 74. Each of the extension members 74 extends downwardly from a respective side of the top frame 68 for slidably engaging an associated one of the side wall members 22. Thus, the top frame 68 is selectively positionable at an angle relative to an upper edge 76 of the side wall members 22.

The base assembly 12 includes at least one handle 78 for facilitating transportation of the base assembly 12. The base assembly 12 also includes a plurality of wheels 13 for facilitating transportation of the base assembly 12. The base assembly 12 includes a plurality of holes 15, each of the holes 15 is designed for receiving an associated one of the protrusions 32 of the side wall members 22. Thus, the side wall members 22 are engaged to the base assembly 12. A ramp 17 extends outwardly from a front side 19 of the base assembly 12.

In use, a user can pitch, throw, hit and kick sports balls into the backstop and sports ball return assembly, which returns the sports ball through the chute to the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A backstop and sports ball return assembly, comprising:

a base assembly, said base assembly having a collection well portion and a chute extending from the collection well, said collection well having an inclined bottom surface and at least one angled wall whereby said collection well is adapted for directing a sports ball towards said chute when the sports ball enters the collection well;

a pair of side wall members coupled to said base, said side wall members extending upwardly from opposite sides of said base assembly;

a rear assembly coupled to said base assembly, said rear assembly extending between said side wall members;

a top assembly coupled to said side wall members and said rear assembly, said top assembly extending generally between said side wall members;

said top assembly including a top frame and top netting coupled to said top frame; and said top frame having a rearward side pivotally coupled to said side wall members proximate said rear assembly, said top frame having a pair of extension members, each of said extension members extending downwardly from a respective side of said top frame for slidably engaging an associated one of said side wall members whereby said top frame is selectively positionable at an angle relative to an upper edge of said side wall members.

2. The backstop and sports ball assembly of claim 1, further comprising:

a sheet member coupled to said rear assembly such that said sheet member hangs freely in front of said rear assembly such that said sheet member is adapted for deadening movement of the sports ball when the sports ball contacts said sheet member whereby the sports ball is directed generally into said collection well.

3. The backstop and sports ball return assembly of claim 1, further comprising:

each of said side wall members having a side wall frame extending around an outer perimeter of said side wall, said frame having a pair of protrusions extending downwardly for engaging said base assembly, and each of said side walls having side wall netting coupled to said side wall frame.

4. The backstop and sports ball return assembly of claim 1, further comprising:

said rear assembly having a substantially horizontal center bar, an upper portion extending upwardly from said center bar and a lower portion extending generally downward from said center bar, said upper portion being pivotal relative to said lower portion, a top bar of said upper portion being coupled between upper corners of said side walls, a lower end of said lower portion being coupled between lower corners of said side walls; and side members of said upper and lower portions being telescopic whereby said rear assembly is adjustably positionable to vary the angles between the upper portion and the lower portion relative to a rearward edge of the side wall members.

5. The backstop and sports ball return assembly of claim 4, further comprising:

upper portion netting coupled to said upper portion of said rear assembly, lower portion netting coupled to said lower portion of said rear assembly, rear side netting coupled between outer edges of said upper portion, lower portion and said side walls.

6. The backstop and sports ball return assembly of claim 1, further comprising:

said base assembly including at least one handle for facilitating transportation of said base assembly.

7. The backstop and sports ball return assembly of claim 1, further comprising:

said base assembly including a plurality of wheels for facilitating transportation of said base assembly.

8. The backstop and sports ball return assembly of claim 3, further comprising:

said base assembly including a plurality of holes, each of said holes being for receiving an associated one of said protrusions of said side wall members whereby said side wall members are engaged to said base assembly.

9. The backstop and sports ball return assembly of claim 1, further comprising:

a ramp extending outwardly from a front side of said base assembly.

10. A backstop and sports ball return assembly, comprising:

a base assembly, said base assembly having a collection well portion and a chute extending from the collection well, said collection well having an inclined bottom surface and at least one angled wall whereby said collection well is adapted for directing a sports ball towards said chute when the sports ball enters the collection well;

a pair of side wall members coupled to said base, said side wall members extending upwardly from opposite sides of said base assembly;

a rear assembly coupled to said base assembly, said rear assembly extending between said side wall members;

a top assembly coupled to said side wall members and said rear assembly, said top assembly extending generally between said side wall members;

a sheet member coupled to said rear assembly such that said sheet member hangs freely in front of said rear assembly such that said sheet member is adapted for deadening movement of the sports ball when the sports ball contacts said sheet member whereby the sports ball is directed generally into said collection well;

each of said side wall members having a side wall frame extending around an outer perimeter of said side wall, said frame having a pair of protrusions extending downwardly for engaging said base assembly, and each of said side walls having side wall netting coupled to said side wall frame;

said rear assembly having a substantially horizontal center bar, an upper portion extending generally upward from said center bar and a lower portion extending generally downward from said center bar, said upper portion being pivotal relative to said lower portion, a top bar of said upper portion being coupled between a pair of upper coupling members extending outwardly from upper corners of said side walls, a lower end of said lower portion being coupled between a pair of lower coupling members extending outwardly from lower corners of said side walls;

side members of said upper and lower portions being telescopic whereby said rear assembly is adjustably positionable to vary the angles between the upper portion and the lower portion relative to a rearward edge of the side wall members;

said lower coupling members having indicia for facilitating aligning of said lower portion;

upper portion netting coupled to said upper portion of said rear assembly, lower portion netting coupled to said lower portion of said rear assembly, rear side netting coupled between outer edges of said upper portion, lower portion and said side walls;

said top assembly including a top frame and top netting coupled to said top frame;

said top frame having a rearward side pivotally coupled to said side wall members proximate said rear assembly, said top frame having a pair of extension members, each of said extension members extending downwardly from a respective side of said top frame for slidably engaging an associated one of said side wall members whereby said top frame is selectively positionable at an angle relative to an upper edge of said side wall members;

said base assembly including at least one handle for facilitating transportation of said base assembly;

said base assembly including a plurality of wheels for facilitating transportation of said base assembly;

said base assembly including a plurality of holes, each of said holes being for receiving an associated one of said protrusions of said side wall members whereby said side wall members are engaged to said base assembly; and a ramp extending outwardly from a front side of said base assembly.

* * * * *